United States Patent [19]

Spray

[11] 4,117,691

[45] Oct. 3, 1978

[54] FLOATING OFFSHORE DRILLING PLATFORM

[76] Inventor: Claude Spray, 6008 Arlington Blvd., Richmond, Calif. 94805

[21] Appl. No.: 823,855

[22] Filed: Aug. 11, 1977

[51] Int. Cl.[2] ..... E02B 17/00

[52] U.S. Cl. ..... 405/205; 9/8 P; 114/264; 405/197; 405/200

[58] Field of Search ..... 61/86, 87, 88, 89, 90, 61/98, 81, 82, 69 R; 9/8 P; 114/264, 265, 257, 256; 175/7

[56] References Cited

U.S. PATENT DOCUMENTS

| | | | |
|---|---|---|---|
| 2,551,375 | 5/1951 | Hayward | 61/88 |
| 2,939,291 | 6/1960 | Schurman et al. | 9/8 P X |
| 3,450,201 | 6/1969 | Blenkarn | 61/81 X |
| 3,895,495 | 7/1975 | Akazaki | 61/98 |

FOREIGN PATENT DOCUMENTS

| | | | |
|---|---|---|---|
| 549,025 | 7/1956 | Belgium | 9/1.3 |

*Primary Examiner*—Jacob Shapiro
*Attorney, Agent, or Firm*—Clarence A. O'Brien; Harvey B. Jacobson

[57] ABSTRACT

A hollow generally circular horizontal float body is provided. The body tapers in thickness from its central portion of its outer periphery and includes upper and lower walls which are inclined downwardly and upwardly, respectively, from the central portion to the outer periphery of the body. A horizontal work platform is spaced above the body and supported therefrom by upstanding supports extending and secured between the body and the platform at points spaced about the central portion of the body. The body includes a central vertical passage therethrough and the interior of the body spaced outwardly of and about the central portion includes structure defining ballast tanks which may be selectively flooded and evacuated of water. A central upstanding caisson is supported at its upper end from the body about the passage and the caisson comprises a plurality of relatively telescopingly engaged tubular sections wih the lower section provided with flotation structure selectively operable for buoying the lower section upwardly toward a retracted position and each successive section of the caisson above the lower section thereof is engageable by the lower section thereunder in order that it may also be buoyed upwardly toward a retracted position. The extreme outer periphery of the body defines an airtight buoyancy chamber spaced outwardly of the ballast tanks and the body, after being properly positioned above a given location of the ocean floor engaged by the lower end of the caisson, includes anchor structure whereby the float body may be anchored in the desired position.

7 Claims, 4 Drawing Figures

88
10
14
2
2
90
90
3
3
16
82
12
12
92
66
92
78
80
98
94

FLOATING OFFSHORE DRILLING PLATFORM

BACKGROUND OF THE INVENTION

Various forms of floating drilling platforms have been heretofore provided. However, most of these previously known floating drilling platforms either include flotation bodies including considerable portions thereof disposed below the water level and therefore subjected to the tremendous forces which may be generated by ocean currents or they have been constructed in the form of ships which are difficult to anchor in a particular location, inasmuch as the broadside of a ship offers considerable area against which tremendous forces may be generated by wind and ocean currents. Therefore, most floating drilling platforms have proven to be ineffective, for one reason or another, in various operating environments.

Examples of various forms of floating drilling platforms and other forms of drilling platforms as well as buoyant structures designed for different purposes and include some of the general structural and operational features of the instant invention are disclosed in U.S. Pat. Nos. 2,881,591, 2,939,291, 2,941,370, 2,987,892, 3,191,388, 3,340,928, 3,472,032, 3,735,435 and Re. 27,261.

BRIEF DESCRIPTION OF THE INVENTION

The floating off-shore drilling platform of the instant invention includes a horizontally disposed buoyant body of generally circular plan shape and including upper and lower wall surfaces which taper downwardly and upwardly, respectively, from a central portion of the body outwardly toward the outer periphery thereof and the body includes flotation tanks whereby the buoyancy thereof may be adjusted in order that the body, supporting the platform thereof, may float on the water with the mean water level at the vertically thin outermost periphery of the body. In this manner, ocean currents effect little drag on the body and ocean waves and wind are ineffective to generate the usual extreme lateral forces on a large floating body to be anchored in position.

The main object of this invention is to provide a floating offshore drilling platform which may be readily anchored in position over a selected area of the ocean bottom and which is constructed in a manner whereby ocean currents, waves and wind directed against the body will generate considerably less lateral forces thereon to displace the body from its anchored position than would be generated by ocean currents, waves and wind on conventional flotation bodies of floating offshore drilling platforms.

Another object of this invention is to provide a floating offshore drilling platform in accordance with the preceding object and including a depending telescopic hollow caisson consisting of at least several telescopically engaged tubular caisson sections and operatively associated with each other whereby flotation structure carried by the lowest caisson section will be effective not only to buoy up the lowest caisson section but to also buoy up the caisson sections thereabove as each has the caisson section therebelow telescoped upwardly thereinto.

Another important object of this invention is to provide a floating offshore oil well drilling platform constructed in a manner whereby strategically placed ballast tanks may be selectively flooded and/or evacuated of water in order to trim the flotation body of the platform.

A further important object of this invention is to provide an apparatus in accordance with the preceding objects and constructed in a manner whereby it may be readily towed from one location to another with little resistance to the passage of the platform through the water when the caisson thereof is upwardly retracted.

Another object of this invention is to provide a flotation body for an offshore drilling platform of the floating type with the flotation body constructed of circular plan shape and including upper and lower walls which taper downwardly and upwardly, respectively, outwardly from a central portion of the body to the outer periphery thereof and with the diameter of the body being such as to insure spanning the distance between crests of large ocean waves.

A final object of this invention to be specifically enumerated herein is to provide a floating offshore drilling platform in accordance with the preceding objects and which will conform to conventional forms of manufacture, be cf simple construction and easy to anchor in position so as to provide a device that will be economically feasible, relatively simple to construct and require a minimum of crew.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
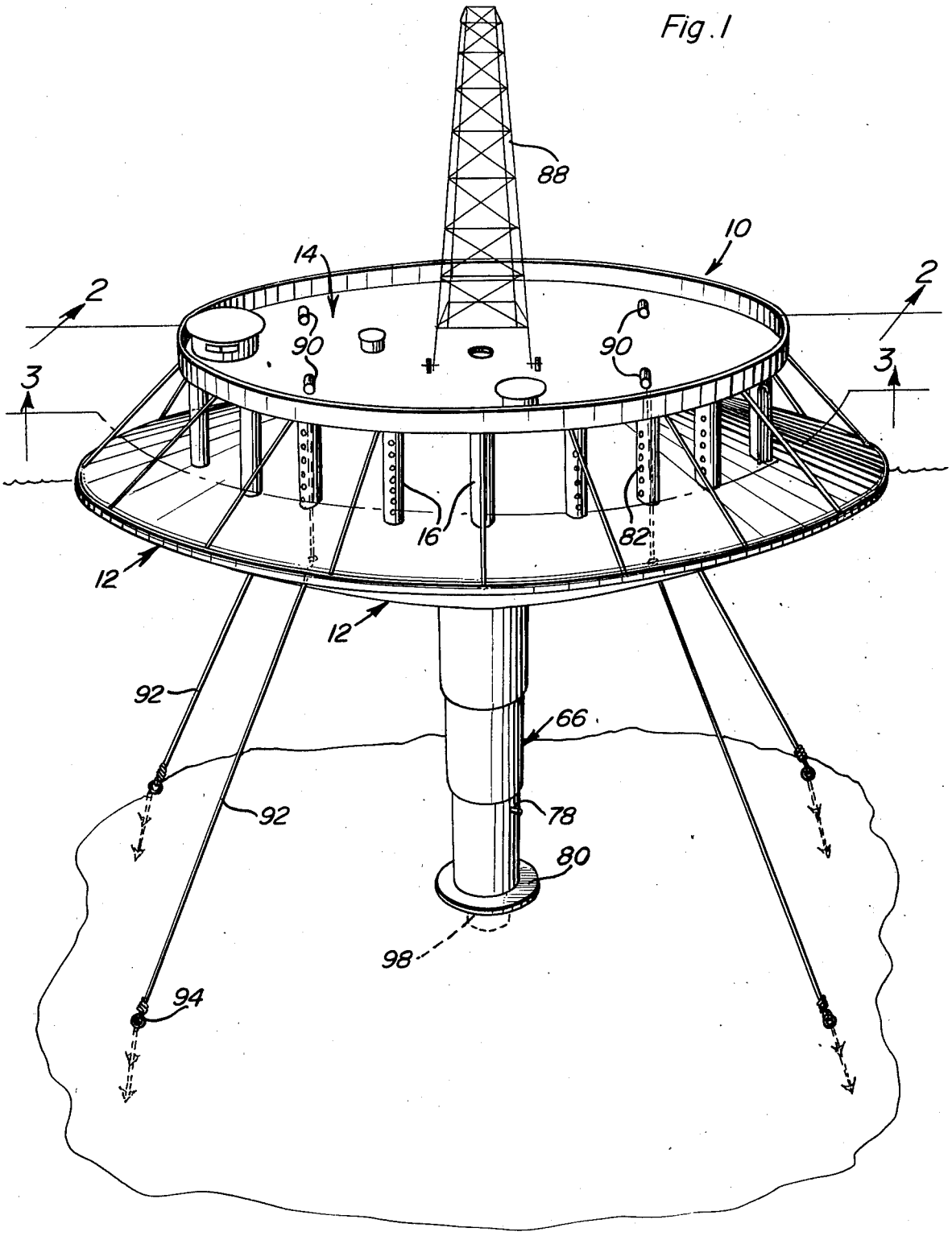
FIG. 1 is a perspective view of the floating offshore drilling platform of the instant invention.
Figure 2:
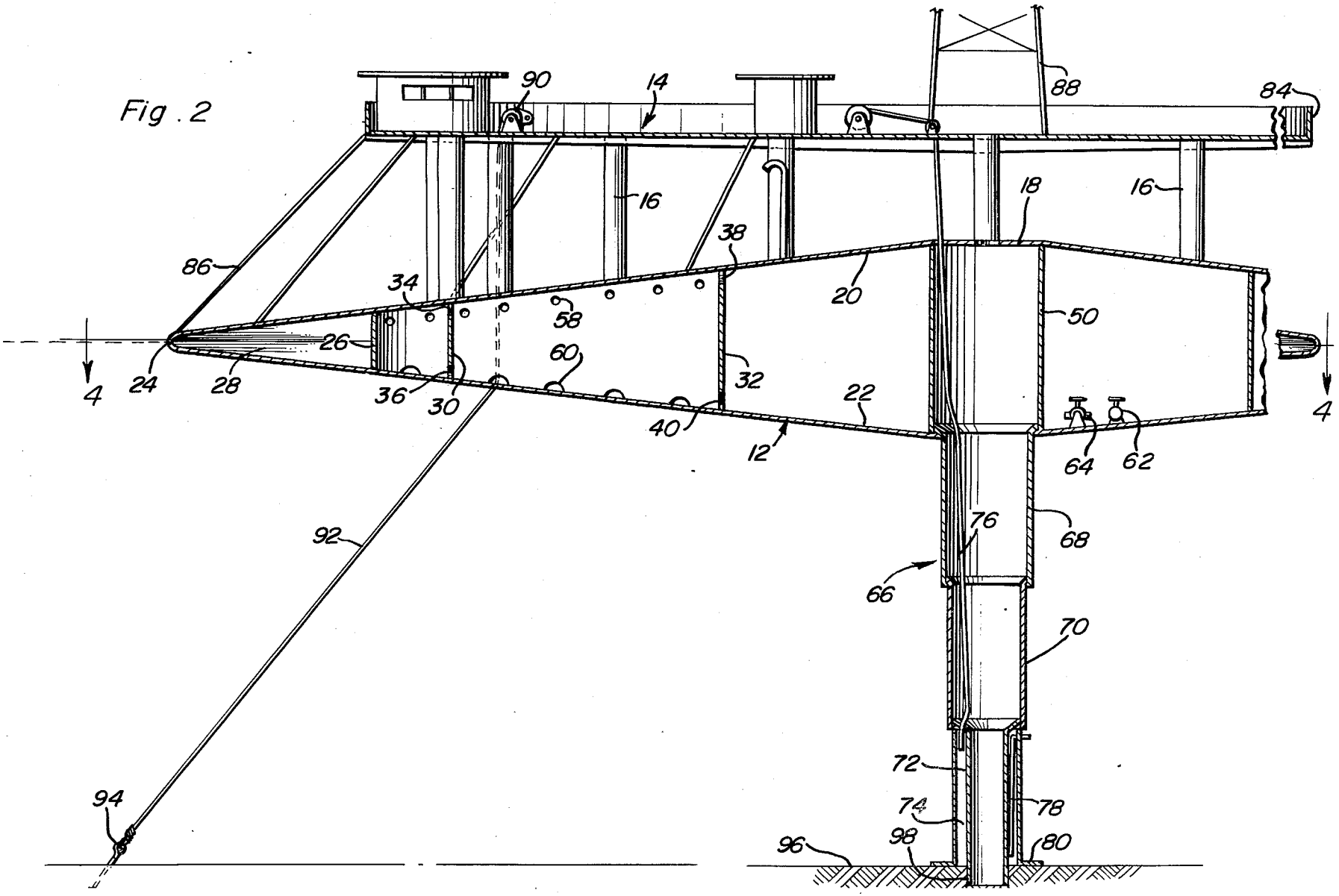
FIG. 2 is a fragmentary enlarged vertical sectional view taken substantially upon the plane indicated by the section line 2—2 of FIG. 1.
Figure 3:
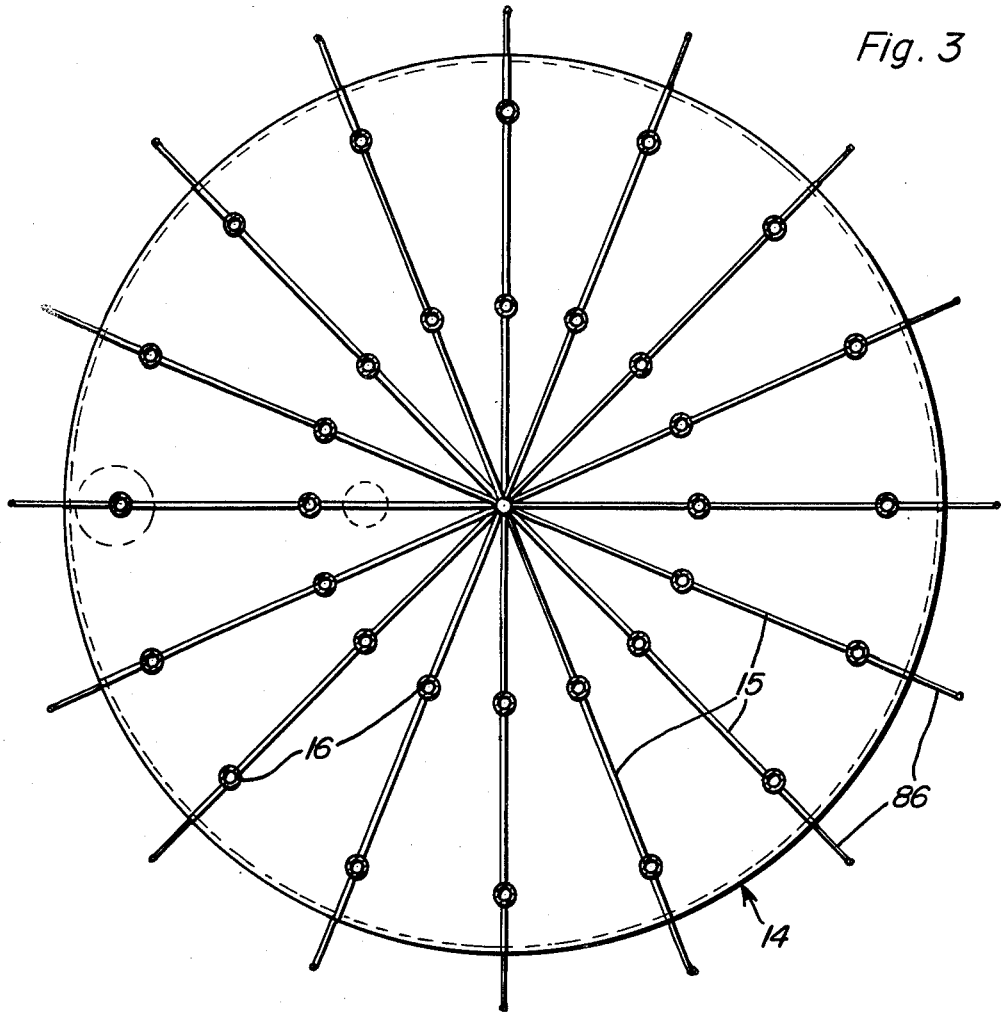
FIG. 3 is a horizontal sectional view taken substantially upon the plane indicated by the section 3—3 of FIG. 1.
Figure 4:
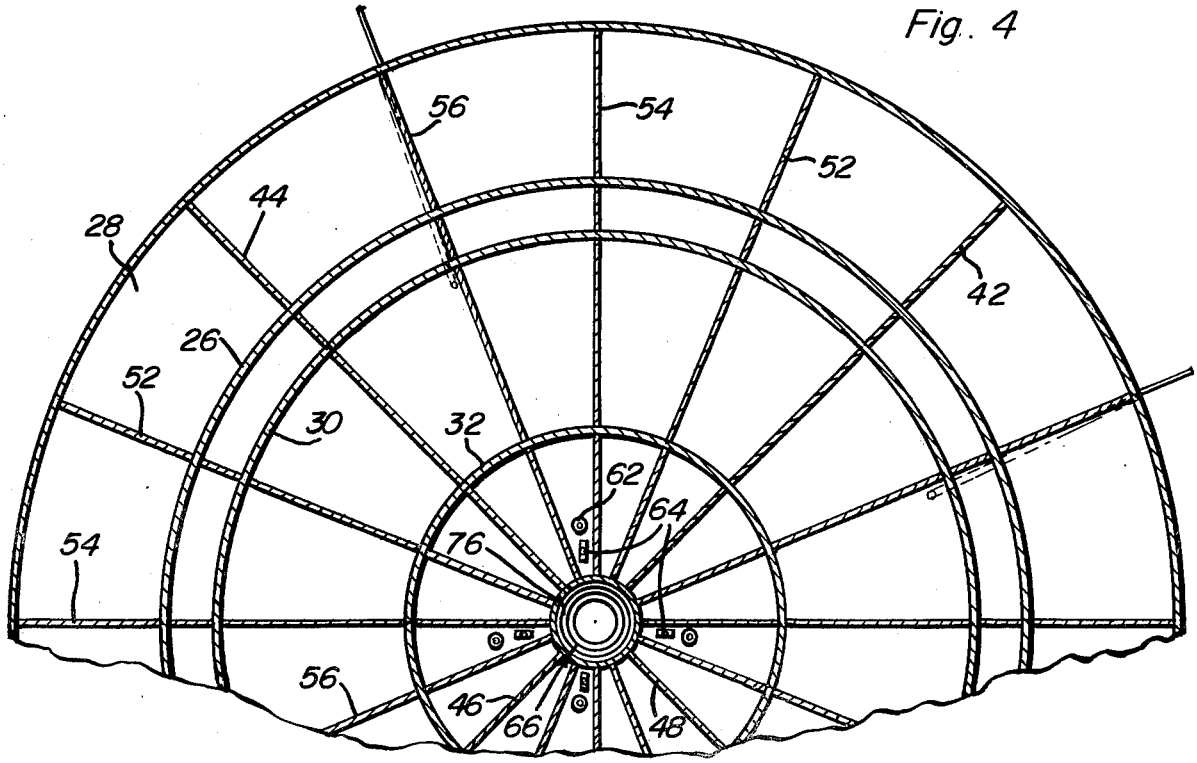
FIG. 4 is a fragmentary horizontal sectional view on somewhat of a reduced scale and taken substantially upon the plane indicated by the section line 4—4 of FIG. 2.

Referring now more specifically to the drawings, the numeral 10 generally designates the floating offshore drilling platform of the instant invention. The platform 10 includes a main flotation body referred to in general by the reference numeral 12 and a platform structure referred to in general by the reference numeral 14 including radial joists 15 and spaced above the body 12 and supported therefrom by upright supports 16 extending and secured between the body 12 and the platform structure 14.

The body 12 is circular in plan shape and includes a central portion 18 and upper and lower walls 20 and 22 which are inclined downwardly and upwardly, respectively, outwardly from the central portion 18 to the outer periphery 24 of the body 12. A cylindrical outer bulkhead 26 is secured between the upper and lower walls 20 and 22 at a point spaced inwardly from the outer periphery 24 and the interior of the body 12 disposed outwardly of the bulkhead 26 defines a permanent airtight outer peripheral flotation chamber 28.

Intermediate and inner cylindrical bulkheads 30 and 32 are also secured between the upper and lower walls 20 and 22 inwardly of the bulkhead 26 and the bulkhead 32.

The bulkheads 30 and 32 include sets of upper and lower openings 34, 36 and 38, 40 formed therethrough and four imperforate radial bulkheads 42, 44, 46 and 48 extend between the upper and lower walls 20 and 22 and a cylindrical sleeve 50 secured in the central portion 18 of the body 12 and the outer periphery 24 of the body 12. Still further, three radial bulkheads 52, 54 and 56 extend between the upper and lower walls 20 and 22 and the sleeve 50 and the outer bulkhead 26 between each pair of adjacent bulkheads 42, 44, 46 and 48, each of the bulkheads 52, 54 and 56 including upper and lower openings 58 and 60 formed therethrough.

The lower wall 22 has a flooding valve 62 in each compartment defined between adjacent bulkheads 42, 44, 46 and 48 for flooding that compartment and a ballast evacuation pump 64 for evacuating that compartment. Further, the sleeve 50 supports the upper end of a tubular telescopic caisson referred to in general by the reference numeral 66 therefrom. The caisson 66 includes an upper tubular caisson section 68, an intermediate tubular caisson section 70 whose upper end is telescoped upwardly into the lower end of the section 68 and a lower tubular caisson section 72 whose upper end is telescoped upwardly into the section 70. The lower caisson section 73 includes an outer flotation chamber 74 into which air may be pumped through an air line 76 extending downwardly from the platform structure 14 and the flotation 74 includes a purge line 78 therefor through which water from the chamber 74 may be exhausted and through which ambient water may enter the chamber 74 upon venting the latter through the line 76 from the platform structure 14. Further, the lower section 72 includes a radial outwardly projecting circumferential flange 80 whose upper surface is engageable with the lower end of the section 70 and the lower end of the section 68. Accordingly, when the flotation chamber 74 is purged of water through the purge line 78 by the admission of air into the chamber 74 through the line 76, the buoyancy of the lower caisson section 78 is sufficient to buoy the latter upwardly until the flange 80 engages the lower end of the section 70 and to thereafter buoy up both sections 70 and 72 until the flange 80 also engages the lower end of the section 68 and the buoyancy of the lower section 72 is thereafter sufficient to also buoy up the section 68. In this manner, the sections 68, 70 and 72 of the caisson 66 may be buoyed upwardly into a position telescoped within the interior of the sleeve 50. Thus, the body 12 may be readily towed over the water with little water resistance to movement of the body 12 over the water.

The flotation chambers defined between adjacent bulkheads 42, 44, 46 and 48 may be selectively flooded and evacuated in order to enable the platform 10 to be floated on a body of water with the mean water level intersecting with the outer periphery 24 of the body 12.

The standards or supports 16 are tubular and include a plurality of openings 82 formed therethrough whereby the forces of waves hitting the support 16 will be minimized. In addition, the outer periphery of the platform structure 14 includes an upstanding peripheral fence 84 and the outer periphery of the platform structure 14 is braced relative to the body 12 by means of upwardly convergent lateral support and fending rods 86 spaced about the platform 10 and extending between the outer periphery of the body 12 and the outer periphery of the platform structure 14.

The platform structure 14 may support a suitable derrick 88 therefrom and also a plurality of anchor cable winches 90 to which anchor cables 92 extending downwardly through selected support 16 may be connected for winding thereon. The anchor cables 92 have suitable anchors 94 on their lower ends whereby the platform 10 may be anchored in position.

When the caisson 66 is downwardly extended for engagement of the lower end thereof with the ocean floor 96 with which the anchors 94 are engaged, the lower caisson section 72 includes a downwardly projecting neck extension 98 below the flange 80 and the neck extension 98 may actually penetrate the ocean floor 96 to a depth equal to the extension of the neck 98 below the flange 80.

The sliding connections between the adjacent caisson sections and the upper caisson section 68 and the sleeve 50 may include seals (not shown) whereby the entire interior of the caisson 66 may be evacuated from the platform structure 14 after the neck extension 98 has been engaged with the ocean bottom 96 to seal the lower end of the caisson 66 closed.

The various flooding valves 62 and pump 64 may be actuated to "trim" the platform 10 according to the manner in which various heavy equipment is loaded thereon. Further, if it is desired, the body 12 may be substantially pulley submerged by flooding the ballast tanks and in this manner substantially all wave action on the body 12 may be eliminated with the lateral forces of waves against the platform 10 thereby being directed only against the perforated support 16.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A floating offshore drilling platform including a hollow generally circular horizontal float body tapering in thickness from its central portion to its outer periphery, said body including upper and lower walls which are inclined downwardly and upwardly, respectively, from said central portion to said outer periphery, a horizontal work platform spaced above said body and supported therefrom by upstanding supports extending and secured between said body and platform at points spaced about said central portion, said body including means defining a central vertical passage therethrough, the interior of said body spaced outwardly of and about said central portion including means defining ballast tanks which may be selectively flooded and evacuated of water, and a central upstanding tubular caisson supported at its upper end from said body about said passage and adapted at its lower end for engagement with the ocean floor, at least the lower end portion of said caisson comprising an extendable and retractable end portion thereof, said retractable end portion including selectively operable flotation means for buoying said lower end portion upwardly toward a retracted position, said flotation means including means defining a closed outer flotation chamber supported from said retractable end portion, flexible air conduit means extending downwardly along said caisson and having a lower end opening into said outer flotation chamber, and purge passage means opening inwardly of the lower portion of said outer flotation chamber and outwardly of the latter.

2. The combination of claim 1 wherein the upper and lower ends of said caisson are open and said lower end is of a configuration to penetrate down into the ocean bottom and to thereby seal the lower end of said caisson against the entrance of water thereinto.

3. The combination of claim 1 wherein said work platform is generally circular in plan shape, and a plurality of upwardly convergent fending and bracing rods spaced about the outer periphery of said body with their upper and lower ends anchored relative to said platform and body.

4. The combination of claim 1 wherein said body includes a central upstanding sleeve structure seatingly secured therethrough, a plurality of generally radial bulkheads secured between said upper and lower walls outwardly of said sleeve structure and dividing at least a portion of the interior of said body outwardly of said sleeve structure into circumferentially spaced individual ballast chambers comprising said ballast tanks, means operatively associated with each of said chambers for selectively flooding and evacuating the same of water.

5. An offshore drilling rig including a hollow flotation body having a central vertical passage formed therethrough, a platform supported from said body above the latter and in registry with said passage, a central upstanding tubular caisson supported at its upper end from said body about said passage and adapted at its lower end for engagement with the ocean floor, at least the lower end portion of said caisson comprising an extendable and retractable end portion thereof, said retractable end portion including selectively operable flotation means for buoying said lower end portion upwardly toward a retracted position, the upper and lower ends of said caisson being open and said lower end being of a configuration to penetrate down into the ocean bottom and to thereby seal the lower end of said caisson against the entrance of water thereinto.

6. The combination of claim 4 wherein the outer periphery of the interior of said body defines a sealed flotation tank, said ballast chambers being disposed inwardly of said flotation tank from said outer periphery.

7. The combination of claim 6 including coextensive arcuate bulkhead sections secured between said upper and lower walls between adjacent radial bulkheads, said bulkhead sections having openings formed therethrough.

* * * * *